US010093518B1

(12) United States Patent
Seki et al.

(10) Patent No.: US 10,093,518 B1
(45) Date of Patent: Oct. 9, 2018

(54) REMOTE INSPECTION OF PASSENGER CONVEYORS

(71) Applicant: Otis Elevator Company, Farmington, CT (US)

(72) Inventors: Hisanori Seki, Tomisato (JP); Atsushi Yamada, Narita (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/834,637

(22) Filed: Dec. 7, 2017

(51) Int. Cl.
*B66B 25/00* (2006.01)
*B66B 27/00* (2006.01)
*B66B 29/00* (2006.01)

(52) U.S. Cl.
CPC ..... *B66B 25/006* (2013.01); *B66B 27/00* (2013.01); *B66B 29/005* (2013.01)

(58) Field of Classification Search
CPC ..... B66B 25/006; B66B 27/00; B66B 29/005
USPC ..... 198/322, 323
See application file for complete search history.

(56) References Cited

U.S. PATENT DOCUMENTS 4,847,894 A 7/1989 Chanvin et al.
6,267,219 B1 * 7/2001 Spannhake ..... B66B 27/00 198/322
6,334,522 B2 * 1/2002 Haruta ..... B66B 25/00 198/322
6,988,607 B2 * 1/2006 Blondiau ..... B66B 25/00 198/322
7,002,462 B2 * 2/2006 Welch ..... B66B 27/00 340/286.02
7,172,055 B2 * 2/2007 Engel ..... B66B 5/0087 187/391
8,412,373 B2 * 4/2013 Kangas ..... B66B 25/00 340/991

(Continued)

FOREIGN PATENT DOCUMENTS

CN 101397113 B 4/2009
CN 202030423 U 11/2011

(Continued)

OTHER PUBLICATIONS

Evans, David, "Specifying Escalator for Transit Projects", Construction Canda, Schindler Elevator Corporation, Sep. 2010, vol. 52, No. 5, 8 pages.

(Continued)

*Primary Examiner* — Gene O Crawford
*Assistant Examiner* — Keith R Campbell
(74) *Attorney, Agent, or Firm* — Cantor Colburn LLP

(57) ABSTRACT

The remote inspection device for a passenger conveyor includes at least one camera mounted directly above the passenger conveyor for monitoring external conditions of the passenger conveyor, a remote controller for performing a remote visual inspection using the camera, a passenger conveyor controller for operating the passenger conveyor at a normal speed during a normal operation and for operating the passenger conveyor at a slower speed or bringing it to a complete stop during a remote visual inspection, and a sensor connected to the passenger conveyor controller and arranged in the vicinity of the entrance of the passenger conveyor for detecting the presence of a passenger approaching the entrance of the passenger conveyor.

21 Claims, 4 Drawing Sheets

(56) References Cited

U.S. PATENT DOCUMENTS

| | | | | |
|---|---|---|---|---|
| 8,794,421 | B2 * | 8/2014 | Senger | B66B 29/005 198/322 |
| 2005/0121288 | A1 | 6/2005 | Blondiau et al. | |
| 2017/0043982 | A1 * | 2/2017 | Wang | B66B 25/00 |

FOREIGN PATENT DOCUMENTS

| | | | | |
|---|---|---|---|---|
| CN | 103267978 | A | | 8/2013 |
| DE | 3611597 | A1 | | 10/1987 |
| JP | 10236757 | A | * | 9/1998 |
| WO | 2011121081 | A1 | | 10/2011 |

OTHER PUBLICATIONS

Pepperl and Fuchs, "Invisible Protection Sensors for the Protection and Movement of People and Vehicles", Factory Automation, issued Nov. 12, 2012, Part No. 181295 09/12 02, 356 pages.

Sensor Partners, "Telco Sensors SMM 01 4033L S50P 5", available at: https://www.sensorpartners.com/en/telco-sensors-smm-01-40331-550p-5.html, accessed Dec. 6, 2017, 8 pages.

Silver Elevator Korea, "Escalator & Moving Walk", available at: http://www.silverelkorea.com/download/silver_es_mw_catalog_eng.pdf, 2013, 10 pages.

Yamashita, Kouji, "Remote Maintenance System and New Maintenance Service for Elevators Enabled by New IoT Service Platford", Hitachi Review vol. 66 (2017), No. 3, pp. 248-253.

* cited by examiner

REMOTE INSPECTION OF PASSENGER CONVEYORS

TECHNICAL FIELD

The present invention relates generally to a remote inspection of a passenger conveyor. In particular, the present invention relates to a remote inspection device and a method of performing a remote inspection for a passenger conveyor.

BACKGROUND ART

Currently, periodic visual inspection of an escalator is not only carried out through an on-site inspection by maintenance personnel, but is also carried out through a remote inspection using at least one camera mounted directly above the vicinity of an entrance of the escalator. By performing a remote inspection, external defects of the escalator can be quickly detected such as abnormal movements or damages of steps or handrails of the escalator, the presence of a foreign matter caught between a comb and steps of the escalator, etc.

When an operator at a remote maintenance center conducts a remote visual inspection, the operator first checks to see if there is no passenger on an escalator. Once the operator confirms that there is no passenger on the escalator, the operator manually switches the escalator's operation mode to an inspection mode which operates the escalator at a slower speed and performs a visual inspection through a video image of the escalator. If a passenger is getting on the escalator during the remote inspection, the operator switches the operation mode back to the normal operation mode manually.

However, due to the limitation of the camera view, the operator may not notice the presence of the passenger just before riding on the escalator. Furthermore, since there is a slight time delay in transmission of the video image until the passenger appears on a display of the remote controller, there is a chance that the passenger had already been on the escalator when the operator noticed the presence of the passenger approaching the escalator entrance. In such an instance, if the escalator operation is switched back to the normal operation mode, the speed of the escalator is suddenly changed, which may result in serious accidents.

Therefore, there exists in the art a need for providing an improved escalator remote inspection device capable of providing quick response to a passenger approaching an escalator entrance during a remote inspection.

SUMMARY OF INVENTION

According to one aspect of the present invention, a remote inspection device for a passenger conveyor is disclosed. The remote inspection device includes at least one camera mounted directly above the passenger conveyor for monitoring external conditions of the passenger conveyor, a remote controller for performing a remote visual inspection using the camera, a passenger conveyor controller for operating the passenger conveyor at a normal speed during a normal operation and for operating the passenger conveyor at a slower speed or bringing it to a complete stop during a remote visual inspection, and a sensor connected to the passenger conveyor controller and arranged in the vicinity of the entrance of the passenger conveyor for detecting the presence of a passenger approaching the entrance of the passenger conveyor.

The remote controller is connected to the passenger conveyor controller and the camera via remote access server. The passenger conveyor controller is configured to transmit a signal to the remote controller for interrupting the initiation of a remote visual inspection in response to the detection of a passenger approaching the entrance when initiating the remote visual inspection, and/or transmit a signal to the remote controller for interrupting the remote visual inspection and resume normal operation of the passenger conveyor in response to the detection of a passenger approaching the entrance during the remote visual inspection.

In some embodiments, the sensor includes a pair of sensors arranged in the vicinity of the entrance side of balustrades on either side of the passenger conveyor.

In some embodiments, each of the pair of sensors is oriented toward the approaching direction of a passenger and its detection range extends in a direction away from the passenger conveyor so that the sensor can detect a passenger in an area out of the camera's view.

In some embodiments, the sensor is arranged in a guidepost, a moving direction guide display or a guide fence disposed in a position spaced apart from the passenger conveyor.

In some embodiments, the sensor includes a Doppler sensor.

In some embodiments, the Doppler sensor includes a pair of Doppler sensors arranged in the vicinity of the entrance side of balustrades on either side of the passenger conveyor.

In some embodiments, each of the pair of Doppler sensors is oriented at a predetermined angle toward the centerline of the passenger conveyor so that the detection ranges of the pair of the Doppler sensors overlap with one another at a predetermined position away from the camera's view.

In some embodiments, the Doppler sensor is arranged to detect moving direction of a passenger approaching the entrance of the passenger conveyor.

In some embodiments, at least one camera is mounted directly above the entrance of the passenger conveyor.

According to another aspect of the present invention, a method of performing a remote inspection for a passenger conveyor is disclosed. The method includes monitoring the presence of a passenger approaching an entrance of the passenger conveyor using a sensor arranged in the vicinity of the entrance of the passenger conveyor, performing a remote visual inspection of external conditions of the passenger conveyor using at least one camera mounted directly above the passenger conveyor if no passenger is detected by the sensor, operating the passenger conveyor at a slower speed or bringing it to a complete stop during the remote visual inspection, and interrupting the remote visual inspection and resuming operation of the passenger conveyor at a normal speed if the sensor detects the presence of a passenger approaching the entrance during the remote visual inspection.

In some embodiments, performing a remote visual inspection further includes monitoring if a passenger appears in the camera's view, and the method further includes interrupting the remote visual inspection and resuming operation of the passenger conveyor at a normal speed if an operator finds a passenger appeared in the camera's view.

In some embodiments, the method further includes resuming the remote visual inspection and operation of the passenger conveyor at the slower speed if the sensor does not detect the presence of a passenger approaching the entrance for a predetermined period of time.

In some embodiments, resuming the remote visual inspection is performed if the sensor does not detect the presence of a passenger for one minute.

In some embodiments, resuming the remote visual inspection is performed manually.

In some embodiments, the sensor includes a pair of sensors arranged in the vicinity of the entrance side of balustrades on either side of the passenger conveyor.

In some embodiments, each of the pair of sensors is oriented toward the approaching direction of a passenger and its detection range extends in a direction away from the passenger conveyor so that the sensor can detect a passenger in an area out of the camera's view.

In some embodiments, the sensor is arranged in a guidepost, a moving direction guide display or a guide fence disposed in a position spaced apart from the passenger conveyor.

In some embodiments, the sensor includes a Doppler sensor.

In some embodiments, the Doppler sensor includes a pair of Doppler sensors arranged in the vicinity of the entrance side of balustrades on either side of the passenger conveyor.

In some embodiments, the Doppler sensor is arranged to detect moving direction of a passenger approaching the entrance of the passenger conveyor.

In some embodiments, at least one camera is mounted directly above the entrance of the passenger conveyor.

These and other aspects of this disclosure will become more readily apparent from the following description and the accompanying drawings, which can be briefly described as follows.

DESCRIPTION OF EMBODIMENTS

Figure 1:
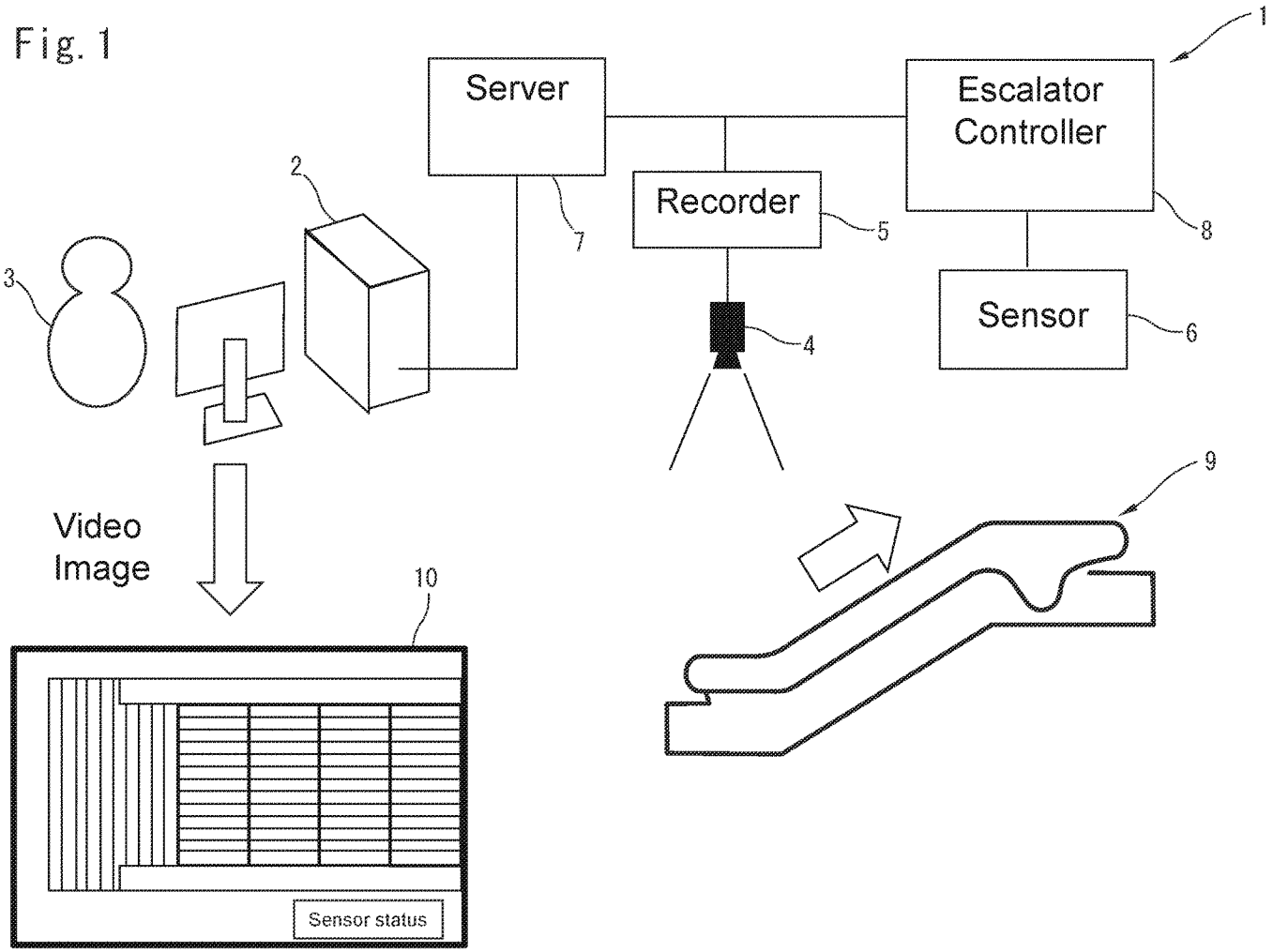
FIG. 1 is a schematic view showing one possible arrangement of a remote inspection device for an escalator in accordance with the present invention.

FIG. 1 shows a schematic diagram of a remote inspection device 1 for an escalator in accordance with the present invention. The remote inspection device 1 includes a remote controller 2 for performing a remote visual inspection by an operator 3, at least one camera 4 for monitoring external conditions of the escalator 9, and a sensor 6 for detecting the appearance of a passenger approaching the entrance of the escalator 9. The camera 4 is basically mounted directly above the entrance of the escalator 9 and configured to monitor the external condition of steps and handrails of the escalator 9. The camera 4 may also comprise a recorder 5 for storing video images. The camera 4 is connected through a remote access server 7 to the remote controller 2 and configured to display video images 10 on a display of the remote controller 2. Although a single camera 4 is shown in FIG. 1 that is disposed directly above the entrance of the escalator 9 moving in an upward direction, the remote inspection device 1 of the present invention may include two cameras 4 arranged directly above the landings on either end of the escalator 9. The two cameras 4 may be configured to monitor external conditions of the escalator around the escalator entrance depending on the moving direction of the escalator 9. The remote inspection device 1 may further include a plurality of cameras 4 depending on the entire length of the escalator 9.

As shown in FIG. 1, the remote controller 2 is connected to the escalator controller 8 via the remote access server 7, and configured to switch the escalator operation between the normal operation mode and the remote inspection operation mode which operates the escalator 9 at a slower speed in response to an initiation of a remote visual inspection of the escalator 9. Further, the sensor 6 is connected to the escalator controller 8 for detecting a passenger approaching the escalator entrance during the remote inspection. The escalator controller 8 is configured to transmit a signal to the remote controller 2 for interrupting the remote visual inspection and resume normal operation of the escalator 9, in response to the presence of a passenger detected by the sensor 6, as described later.

Figure 2:
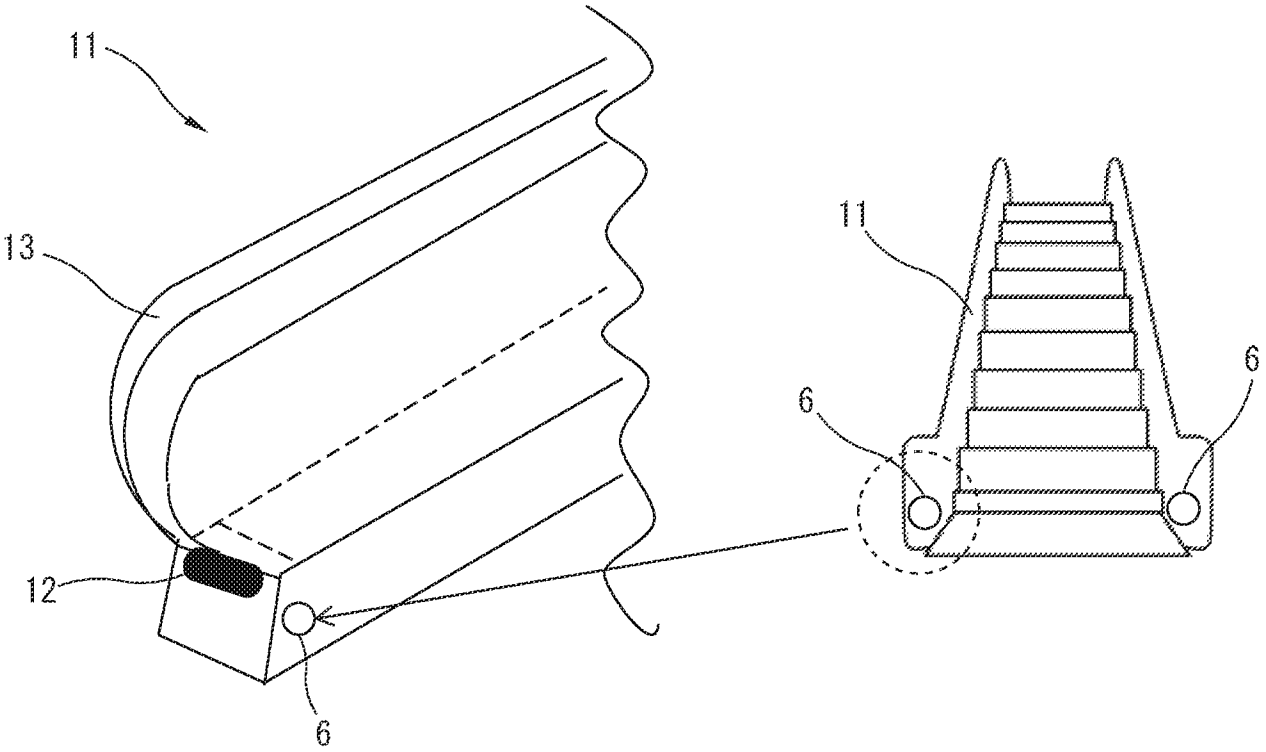
FIG. 2 is a schematic view showing one possible arrangement of a pair of sensors for detecting a passenger approaching an escalator entrance during a remote visual inspection, in accordance with the present invention.

FIG. 2 shows an arrangement of the sensor 6 for detecting a passenger approaching the escalator entrance during the remote visual inspection, in accordance with the present invention. In one example, a pair of sensors 6, 6 is arranged in the vicinity of the entrance side of the corresponding pair of balustrades 11, 11. Specifically, each of a pair of sensors 6 is arranged near the inlet guard 12 of the corresponding handrail 13 on each side of the escalator 9. It should be understood that the sensor 6 may be any sensor capable of sensing the appearance of a passenger approaching the escalator entrance, such as a reflected light detection sensor, an ultrasonic sensor, an infrared radiation sensor, a Doppler sensor, etc. Preferably, each of the pair of sensors 6 arranged on the corresponding balustrade 11 is oriented toward the approaching direction of a passenger and its detection range extends in a divergent manner in a direction away from the escalator 9 so that the sensor 6 can detect a passenger before entering into a range that can be recognized by the camera 4. In another example, the sensor 6 may be disposed in a guidepost, a moving direction guide display or a guide fence disposed in a position spaced apart from the escalator 9. In a further example, the sensor 6 may be placed on the ceiling near the escalator entrance. It should be understood that various sensors 6 at various locations may be alternatively or additionally be provided.

Next, the remote visual inspection method of an escalator using the remote inspection device 1 in accordance with the present invention will be described.

Figure 3:
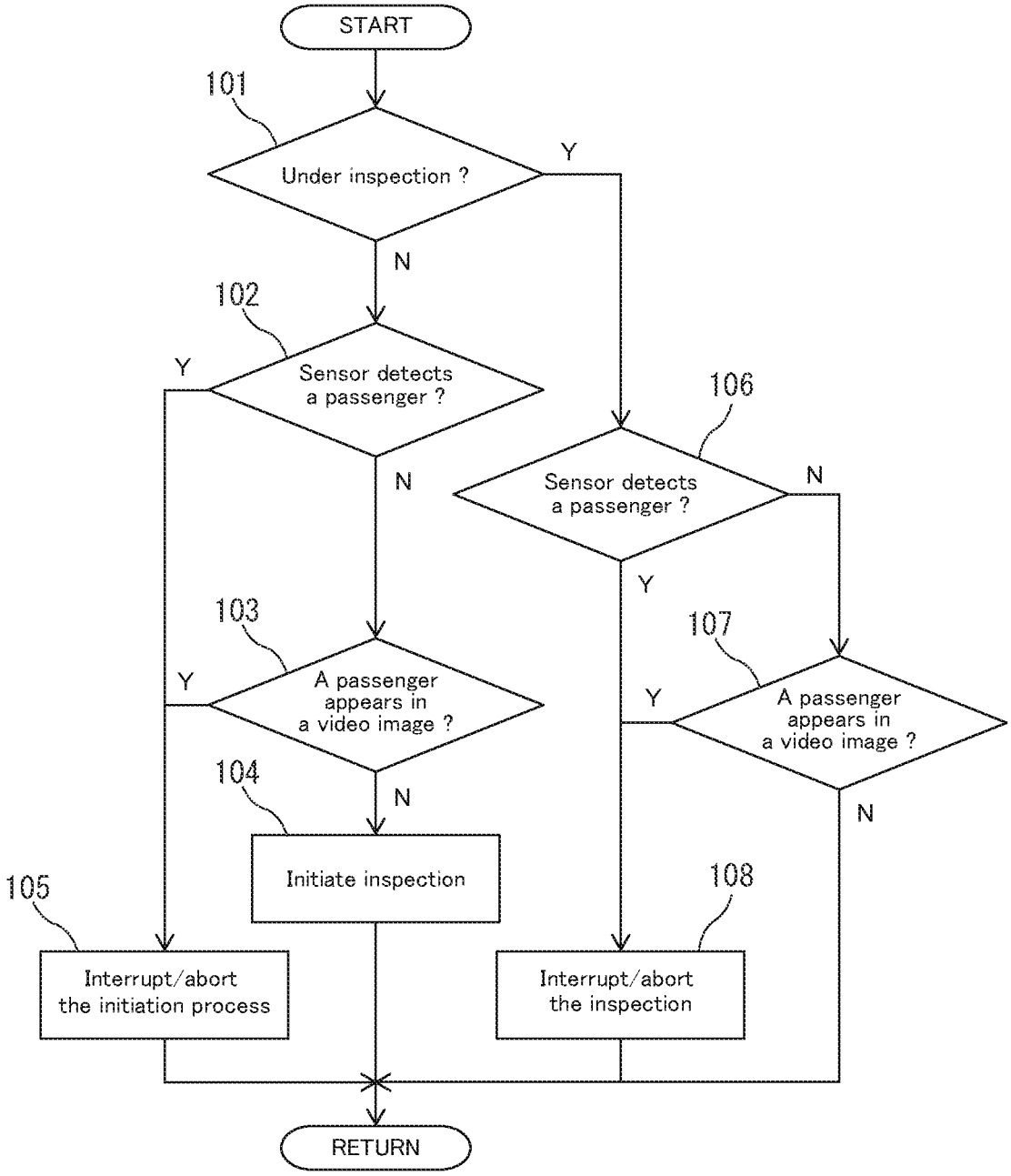
FIG. 3 is a flow diagram of exemplary operations performed by the remote inspection device in accordance with the present invention.

FIG. 3 is a flowchart of exemplary operations performed by the remote inspection device 1 of the present invention. The process begins at step 101 where operator 3 triggers the remote controller 2 to initiate a remote inspection and the remote controller 2 determines if the escalator 9 is undergoing an inspection. If not, flow proceeds to step 102 where the controller 2 determines if the sensor 6 detects the presence of a passenger approaching the escalator 9 entrance. If the sensor 6 detects the presence of a passenger approaching the escalator 9 entrance, the flow proceeds to step 105 to stop initiating the remote inspection. At step 105, the initiation of the remote inspection may be resumed manually by the operator 3. Alternatively, it may be resumed automatically if the sensor 6 does not detect the presence of a passenger approaching the escalator 9 for a predetermined period of time, e.g., for one minute. Following the execution of step 105, flow returns to step 101 to repeat the inspection initiation process.

If the sensor 6 does not detect the presence of a passenger at step 102, then the flow proceeds to step 103 where the operator 3 checks to see whether a passenger appears in the video image 10. If the operator 3 confirms that there is no passenger in the video image 10, flow proceeds to step 104 to initiate the remote inspection. In response to the initiation of the remote inspection at step 104, the remote controller 2 transmits a signal to the escalator controller 8 to operate the escalator 9 in the remote inspection mode, which drives the escalator 9 at a slower speed. Following the execution of step 104, flow returns to step 101 to proceed to the steps performed during the remote visual inspection.

During the remote inspection, the algorithm verifies that the escalator 9 is undergoing the remote inspection at step 101, followed by proceeding to step 106 where the controller 2 determines if the sensor 6 detects the presence of a passenger approaching the escalator 9 during the remote inspection.

If the sensor 6 detects the presence of a passenger approaching the escalator 9 at step 106, flow proceeds to step 108 to interrupt the remote inspection. At step 108, in response to the detection of the presence of a passenger at the escalator entrance, the escalator controller 8 sends a signal to interrupt the remote visual inspection to the remote controller 2 while resuming operation of the escalator 9 in the normal operation mode.

At step 108, the remote visual inspection may be resumed manually by the operator 3 if the operator 3 verifies that there is no passenger approaching the escalator entrance, followed by proceeding to step 101 to repeat process. Alternatively, it may be resumed automatically if the sensor 6 does not detect the presence of a passenger approaching the escalator 9 for a predetermined period of time, e.g., for one minute. The escalator operation may be switched back to the remote inspection mode when the remote inspection is resumed.

Again, at step 106, if the sensor 6 does not detect the presence of a passenger approaching the escalator 9 during the remote inspection, flow proceeds to step 107 where the operator 3 can check to see whether a passenger appears in the video image 10 while carrying out the remote inspection visually. If the operator 3 finds a passenger in the video image 10 at step 107 despite no detection of the passenger at step 106, it follows that a fault has occurred in one of the sensor systems. In the unlikely event that the fault has occurred in the sensor 6, the operator 3 can interrupt the remote inspection manually to operate the escalator 9 in the normal operation mode. If there is no passenger captured in the video image at step 107, i.e., if the remote inspection is not interrupted by the operator 3 manually, flow proceeds to step 101 to repeat process. This algorithm continues until the remote inspection is terminated by the operator 3.

With such a configuration, it is possible to appropriately perform switching of the escalator operation mode between the normal operation mode and the remote inspection mode during a remote visual inspection. Thus, the potential risk of a serious accident associated with sudden speed changes of the escalator can be avoided even if a passenger is getting on the escalator 9 during a remote inspection.

Figure 4:
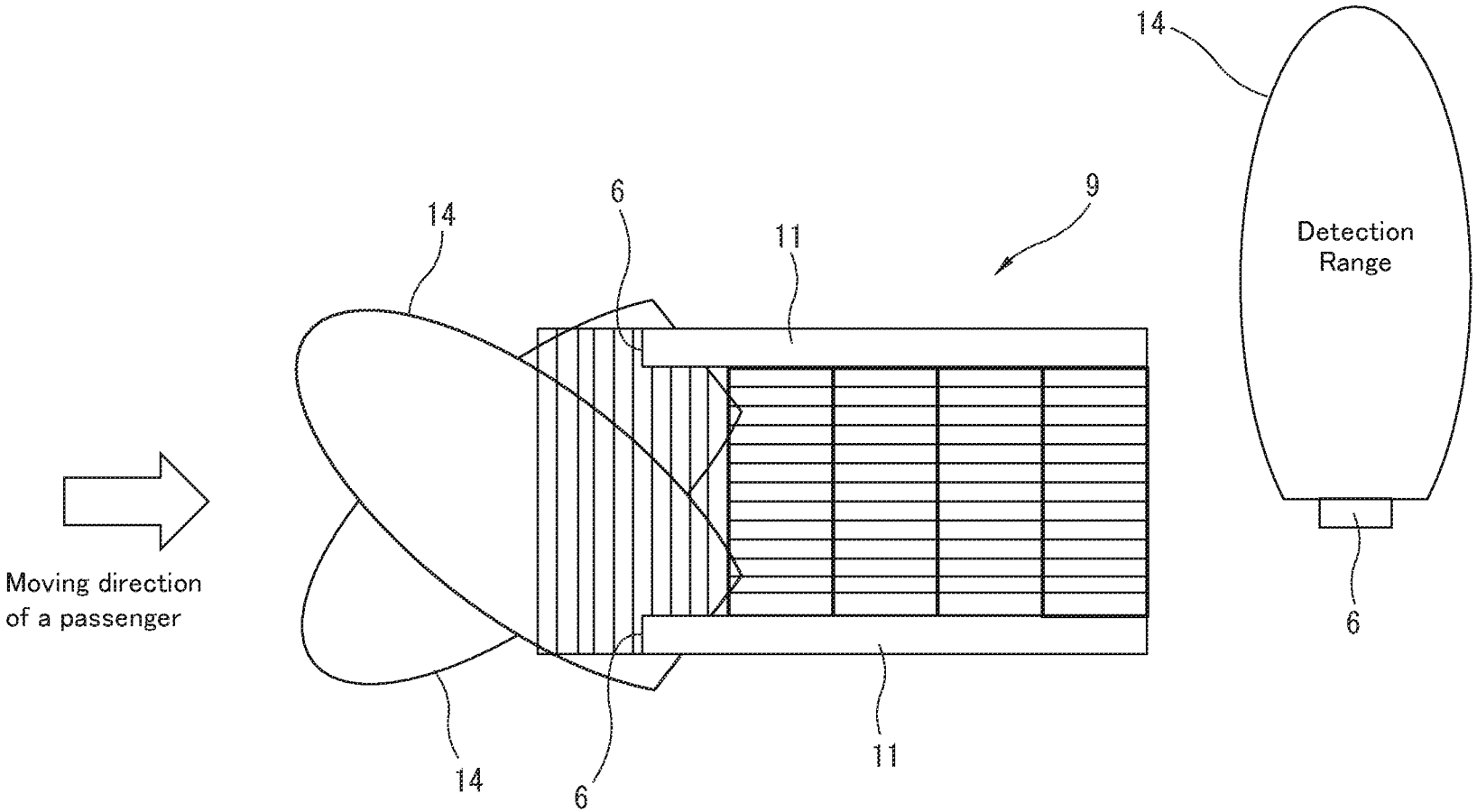
FIG. 4 illustrates an embodiment of the remote inspection device using a pair of Doppler sensors.

FIG. 4 illustrates an embodiment using a pair of Doppler sensors as the sensors 6 for the remote inspection device 1 in accordance with the present invention. As shown in FIG. 4, each of the pair of Doppler sensors 6, 6 is disposed in the vicinity of the end portion of the corresponding balustrade 11 at the escalator entrance. In particular, as shown in FIG. 4, each of the pair of sensors 6, 6 is oriented at a predetermined angle toward the centerline of the escalator 9 so that the detection ranges 14, 14 of the pair of sensors 6, 6 overlap with one another at a predetermined position away from the end portions of the balustrades 11 at the escalator entrance or at a position away from the camera's view. For example, the detection ranges 14, 14 may overlap at a position of one meter away from the camera's view. It should be understood that the detection range and orientation of the Doppler sensors 6 may be adjustable depending on the installation requirements of the escalator 9.

Using a Doppler sensor as the sensor 6 makes it possible to detect moving direction of a passenger approaching the escalator entrance with a simple device. In particular, a Doppler sensor can identify not only a passenger trying to enter from a side of the escalator entrance, but also a person just crossing the detection area 14 of the sensor 6. Thus, the detection efficiency of a passenger approaching the entrance during a remote inspection is improved and unwanted interruptions of remove inspection can be prevented.

Furthermore, since a Doppler sensor can detect the presence of a passenger approaching the escalator entrance over a relatively wide range in comparison with other sensor devices, the remote inspection device 1 can provide a quick switching of the escalator operation mode before the passenger reaches the escalator entrance. Especially, using a Doppler sensor is advantageous in that it enables a reliable detection of a passenger approaching the escalator entrance in an outdoor environment since a Doppler sensor is not influenced by sunlight and dust.

Although the present invention is described with referenced to the escalator 9, it should be understood that the present invention may be applied to any passenger conveyor such as a moving walkway.

While the present invention has been particularly shown and described with reference to the exemplary embodiments as illustrated in the drawings, it will be recognized by those skilled in the art that various modifications may be made without departing from the spirit and scope of the invention as disclosed in the accompanying claims.

What is claimed is:

1. A remote inspection device for a passenger conveyor, comprising:

at least one camera mounted directly above the passenger conveyor for monitoring external conditions of the passenger conveyor;

a remote controller for performing a remote visual inspection using the camera;

a passenger conveyor controller for operating the passenger conveyor at a normal speed during a normal operation and for operating the passenger conveyor at a slower speed or bringing it to a complete stop during a remote visual inspection; and a sensor connected to the passenger conveyor controller and arranged in the vicinity of the entrance of the passenger conveyor for detecting the presence of a passenger approaching the entrance of the passenger conveyor, wherein the remote controller is connected to the passenger conveyor controller and the camera via remote access server, and wherein the passenger conveyor controller is configured to transmit a signal to the remote controller for interrupting the initiation of a remote visual inspection in response to the detection of a passenger approaching the entrance when initiating the remote visual inspection, and/or transmit a signal to the remote controller for interrupting the remote visual inspection and resume normal operation of the passenger conveyor in response to the detection of a passenger approaching the entrance during the remote visual inspection.

2. The remote inspection device of claim 1, wherein the sensor includes a pair of sensors arranged in the vicinity of the entrance side of balustrades on either side of the passenger conveyor.

3. The remote inspection device of claim 2, wherein each of the pair of sensors is oriented toward the approaching direction of a passenger and its detection range extends in a direction away from the passenger conveyor so that the sensor can detect a passenger in an area out of the camera's view.

4. The remote inspection device of claim 1, wherein the sensor is arranged in a guidepost, a moving direction guide display or a guide fence disposed in a position spaced apart from the passenger conveyor.

5. The remote inspection device of claim 1, wherein the sensor includes a Doppler sensor.

6. The remote inspection device of claim 5, wherein the Doppler sensor includes a pair of Doppler sensors arranged in the vicinity of the entrance side of balustrades on either side of the passenger conveyor.

7. The remote inspection device of claim 6, wherein each of the pair of Doppler sensors is oriented at a predetermined angle toward the centerline of the passenger conveyor so that the detection ranges of the pair of the Doppler sensors overlap with one another at a predetermined position away from the camera's view.

8. The remote inspection device of claim 5, wherein the Doppler sensor is arranged to detect moving direction of a passenger approaching the entrance of the passenger conveyor.

9. The remote inspection device of claim 1, wherein the at least one camera is mounted directly above the entrance of the passenger conveyor.

10. A method of performing a remote inspection for a passenger conveyor, the method comprising:

monitoring the presence of a passenger approaching an entrance of the passenger conveyor using a sensor arranged in the vicinity of the entrance of the passenger conveyor;

performing a remote visual inspection of external conditions of the passenger conveyor using at least one camera mounted directly above the passenger conveyor, if no passenger is detected by the sensor;

operating the passenger conveyor at a slower speed or bringing it to a complete stop during the remote visual inspection; and interrupting the remote visual inspection and resuming operation of the passenger conveyor at a normal speed, if the sensor detects the presence of a passenger approaching the entrance during the remote visual inspection.

11. The method of claim 10, wherein performing a remote visual inspection further includes monitoring if a passenger appears in the camera's view, and further including:

interrupting the remote visual inspection and resuming operation of the passenger conveyor at a normal speed, if an operator finds a passenger appeared in the camera's view.

12. The method of claim 10, further comprising:

resuming the remote visual inspection and operation of the passenger conveyor at the slower speed if the sensor does not detect the presence of a passenger approaching the entrance for a predetermined period of time.

13. The method of claim 12, wherein resuming the remote visual inspection is performed if the sensor does not detect the presence of a passenger for one minute.

14. The method of claim 12, wherein resuming the remote visual inspection is performed manually.

15. The method of claim 10, wherein the sensor includes a pair of sensors arranged in the vicinity of the entrance side of balustrades on either side of the passenger conveyor.

16. The method of claim 15, wherein each of the pair of sensors is oriented toward the approaching direction of a passenger and its detection range extends in a direction away from the passenger conveyor so that the sensor can detect a passenger in an area out of the camera's view.

17. The method of claim 10, wherein the sensor is arranged in a guidepost, a moving direction guide display or a guide fence disposed in a position spaced apart from the passenger conveyor.

18. The method of claim 10, wherein the sensor includes a Doppler sensor.

19. The method of claim 18, wherein the Doppler sensor includes a pair of Doppler sensors arranged in the vicinity of the entrance side of balustrades on either side of the passenger conveyor.

20. The method of claim 18, wherein the Doppler sensor is arranged to detect moving direction of a passenger approaching the entrance of the passenger conveyor.

21. The method of claim 10, wherein the at least one camera is mounted directly above the entrance of the passenger conveyor.

* * * * *